US008785091B1

(12) United States Patent
Wu et al.

(10) Patent No.: US 8,785,091 B1
(45) Date of Patent: Jul. 22, 2014

(54) POLYARYLATECARBONATE CONTAINING PHOTOCONDUCTORS

(71) Applicant: Xerox Corporation, Norwalk, CT (US)

(72) Inventors: Jin Wu, Pittsford, NY (US); Kenny-Tuan T Dinh, Webster, NY (US); Terry L Street, Fairport, NY (US); Robert W Hedrick, Spencerport, NY (US); Linda L Ferrarese, Rochester, NY (US); Than Sorn, Walworth, NY (US); Lanhui Zhang, Webster, NY (US); Lin Ma, Pittsford, NY (US); Stanley J Pietrzykowski, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/862,399

(22) Filed: Apr. 13, 2013

(51) Int. Cl.
*G03G 5/05* (2006.01)

(52) U.S. Cl.
CPC ..... *G03G 5/0564* (2013.01); *G03G 5/0589* (2013.01)
USPC ..... 430/59.6; 430/58.8; 430/59.4; 430/59.1; 430/66; 430/60

(58) Field of Classification Search
CPC ..... G03G 5/0564; G03G 5/0589
USPC ..... 430/59.6, 58.8, 59.4, 59.1, 66, 60
See application file for complete search history.

(56) References Cited

U.S. PATENT DOCUMENTS

| | | | | |
|---|---|---|---|---|
| 4,772,526 | A * | 9/1988 | Kan et al. | 430/96 |
| 5,130,215 | A * | 7/1992 | Adley et al. | 430/96 |
| 5,215,843 | A | 6/1993 | Aizawa | |
| 5,725,982 | A * | 3/1998 | Nogami et al. | 430/59.6 |
| 7,498,108 | B2 | 3/2009 | Wu et al. | |
| 7,799,494 | B2 | 9/2010 | Wu et al. | |
| 7,811,732 | B2 | 10/2010 | Wu | |
| 7,897,311 | B2 | 3/2011 | Wu | |
| 2006/0029871 | A1 * | 2/2006 | Hu et al. | 430/59.6 |
| 2007/0019984 | A1 * | 1/2007 | Inagaki et al. | 430/58.05 |
| 2009/0253060 | A1 * | 10/2009 | Yu | 430/58.8 |
| 2013/0330665 | A1 * | 12/2013 | Wu et al. | 430/64 |

FOREIGN PATENT DOCUMENTS

| | | | | |
|---|---|---|---|---|
| JP | 07295250 | A * | 11/1995 | G03G 5/05 |

OTHER PUBLICATIONS

English language machine translation of JP 07-295250 (Nov. 1995).*

* cited by examiner

*Primary Examiner* — Christopher Rodee
(74) *Attorney, Agent, or Firm* — Eugene O. Palazzo

(57) ABSTRACT

A photoconductor that includes, for example, a supporting substrate, an optional ground plane layer, an optional hole blocking layer, an optional adhesive layer, a photogenerating layer, a charge transport layer, and an optional protective coating, and where the charge transport layer contains a mixture of a charge transport component and a polyarylatecarbonate.

18 Claims, 1 Drawing Sheet

POLYARYLATECARBONATE CONTAINING PHOTOCONDUCTORS

CROSS-REFERENCE TO COPENDING APPLICATION

Disclosed in copending patent application, U.S. application Ser. No. 13/862,402, filed concurrently herewith, and the disclosure of which is totally incorporated herein by reference, is an intermediate transfer member comprising a polyarylatecarbonate.

Disclosed herein are photoconductors comprised of a photogenerating layer and a charge transport layer comprised of a mixture of a charge transport component and a polyarylatecarbonate.

BACKGROUND

Photoconductors that include certain photogenerating layers and specific charge transport layers are known. While these photoconductors may be useful for xerographic imaging and printing systems, a number of them have a tendency to deteriorate, and thus have to be replaced at considerable costs and with extensive resources. A number of known photoconductors also have a minimum of, or lack of, resistance to abrasion from dust, charging rolls, toner, and carrier. For example, the surface layers of photoconductors are subject to scratches, which decrease their lifetime, and in xerographic imaging systems adversely affect the quality of the developed images. Although used photoconductor components may be partially recycled, there continues to be added costs and potential environmental hazards when recycling.

Thus, there is a need for photoconductors with extended lifetimes and reduced wearing characteristics.

There is also a need for light shock and ghost resistant photoconductors with excellent or acceptable mechanical characteristics, especially in xerographic systems where biased charging rolls (BCR) are used.

Moreover, there is a need for abrasion resistant or abrasion free, and scratch resistant or scratch free photoconductive surface layers.

Photoconductors with excellent cyclic characteristics and stable electrical properties, stable long term cycling, minimal charge deficient spots (CDS), and acceptable lateral charge migration (LCM) characteristics are also desirable needs.

Further, there is a need for photoconductors where there is prevented or minimized the oxidation of the charge transport compounds present in the charge transport layer by nitrous oxide ($NO_x$) originating from xerographic corotron or xerographic scorotron devices.

Another need relates to the provision of photoconductors which simultaneously exhibit excellent photoinduced discharge and charge/discharge cycling stability characteristics (PIDC) and improved bias charge roll (BCR) wear resistance in xerographic imaging and printing systems.

Yet another need resides in providing photoconductors that include high glass transition temperatures (Tg) of, for example, from about 140° C. to about 240° C. polymer binders, and which binders are also compatible with polycarbonate binders.

These and other needs are believed to be achievable with the photoconductors disclosed herein.

SUMMARY

Disclosed is a photoconductor comprising a charge transport layer containing a polyarylatecarbonate.

Also illustrated herein is a photoconductor comprised in sequence of a supporting substrate, a hole blocking layer thereover, a photogenerating layer, and a charge transport layer comprised of a mixture of an aryl amine hole transport compound and a polyarylatecarbonate as represented by the following formulas/structures

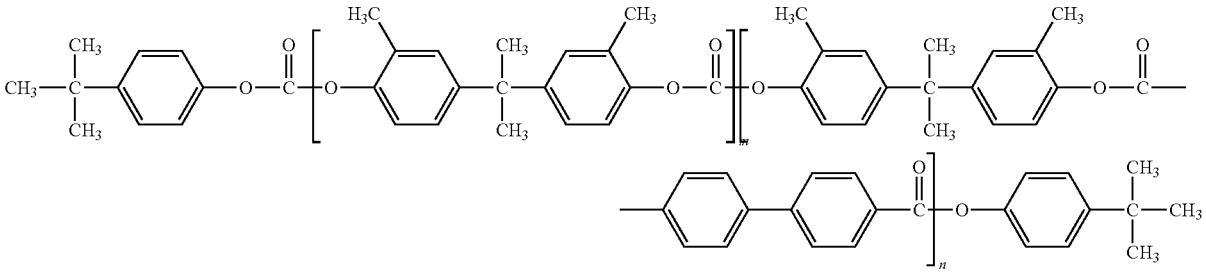

wherein m is from about 65 to about 85 mol percent, and n is from about 15 to about 35 mol percent, and the total thereof is 100 mol percent.

Yet additionally, disclosed herein is a photoconductor comprising a supporting substrate, a hole blocking layer thereover, a photogenerating layer, and a hole transport layer comprised of a mixture of a hole transport compound and a polyarylatecarbonate, and which photoconductor possesses a wear rate of from about 35 to about 65 nm/kcycle.

FIGURES

There are provided the following Figures to further illustrate the photoconductors disclosed herein.

EMBODIMENTS

In embodiments of the present disclosure, there is illustrated a photoconductor comprising an optional supporting substrate, a photogenerating layer, and a polyarylatecarbonate containing charge transport layer.

Figure 1:
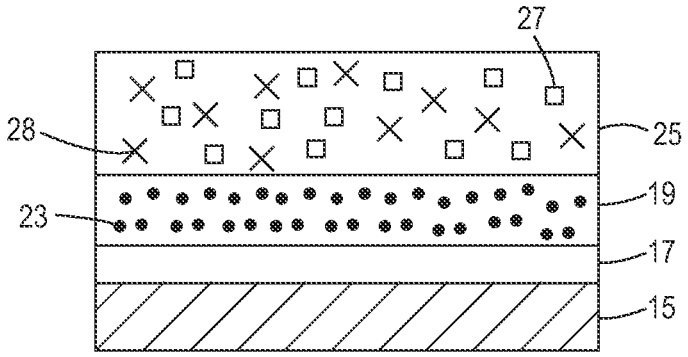
FIG. 1 illustrates an exemplary embodiment of a layered photoconductor of the present disclosure.
Figure 2:
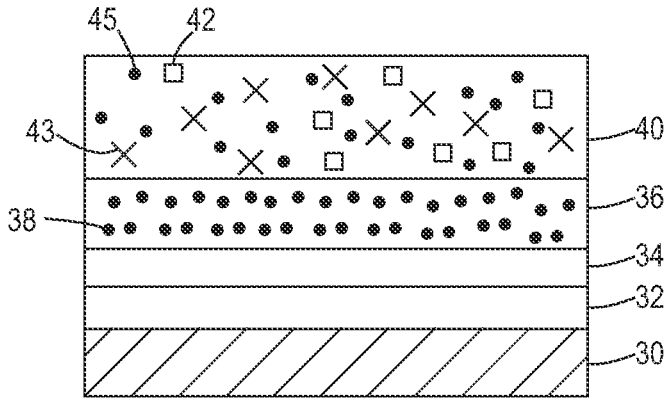
FIG. 2 illustrates an exemplary embodiment of a layered photoconductor of the present disclosure.

Exemplary and non-limiting examples of photoconductors according to embodiments of the present disclosure are depicted in FIGS. 1 and 2, and where the optional protective top coating is not shown.

In FIG. 1, there is illustrated a photoconductor comprising an optional supporting substrate layer 15, an optional hole blocking layer 17, a photogenerating layer 19 containing photogenerating pigments 23, and a charge transport layer 25 containing a mixture of charge transport compounds 27, and polyarylatecarbonates 28.

In FIG. 2, there is illustrated a photoconductor comprising an optional supporting substrate layer 30, an optional hole blocking layer 32, an optional adhesive layer 34, a photogenerating layer 36 containing inorganic or organic photogenerating pigments 38, and a charge transport layer 40 containing charge transport compounds 42, a polyarylatecarbonate copolymer first binder 43, and a second optional binder of a polymer 45, such as a polycarbonate.

Polyarylatecarbonates

Various polyarylatecarbonates can be selected for inclusion in the photoconductor charge transport layer or layers of the present disclosure. Examples of polyarylatecarbonates selected for the charge transport layer and obtainable from Mitsubishi Gas Chemical Company, Inc. are represented by the following formulas/structures and mixtures thereof

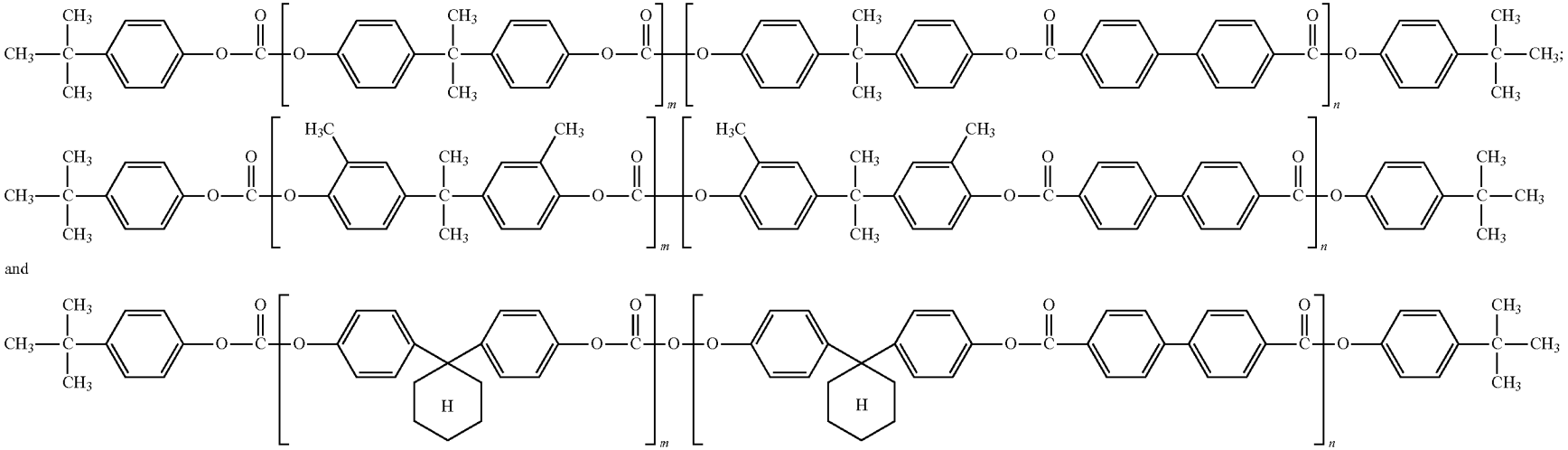
and wherein m and n are the mol percents of each segment, respectively, as measured by known methods, and more specifically by NMR, with m being, for example, from about 60 to about 90 mol percent, from about 60 to about 95 mol percent, from about 70 to about 90 mol percent, from about 75 to about 85 mol percent, from about 65 to about 85 mol percent, or from about 80 mol percent to about 85 mol percent; n being, for example, from about 5 to about 40 mol percent, from about 10 to about 40 mol percent, from about 15 to about 35 mol percent, from about 15 to about 25 mole percent, or from about 15 to about 20 mol percent, with the total of m and n being equal to about 100 mol percent.

Specific examples of polyarylatecarbonate copolymers prepared by and obtainable from Mitsubishi Gas Chemical Company, Inc., and comprising a biphenyl moiety are represented by the following formulas/structures wherein m and n are the mol percents as disclosed herein, and yet more specifically, wherein m and n are as illustrated below, and wherein the viscosity average molecular weight ($M_v$) was provided by Mitsubishi Gas Chemical Company, Inc., and which viscosity average molecular weight may be determined by known viscosity measurement processes.

PAC-A80BP20

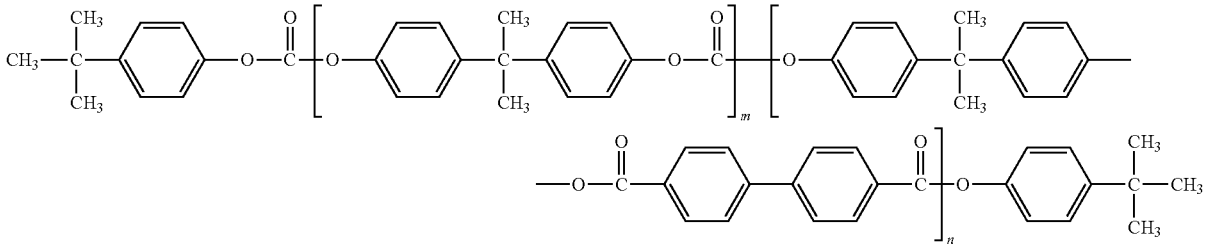

wherein m is from about 75 to about 85 mole percent, and n is from about 15 to about 25 mol percent, with the total of m and n being equal to about 100 mol percent, and more specifically, where m is equal to about 80 mol percent and n is equal to about 20 mol percent, with the total of m and n being equal to about 100 mol percent, and with the viscosity average molecular weight being equal to about 57,200.

PAC-C80BP

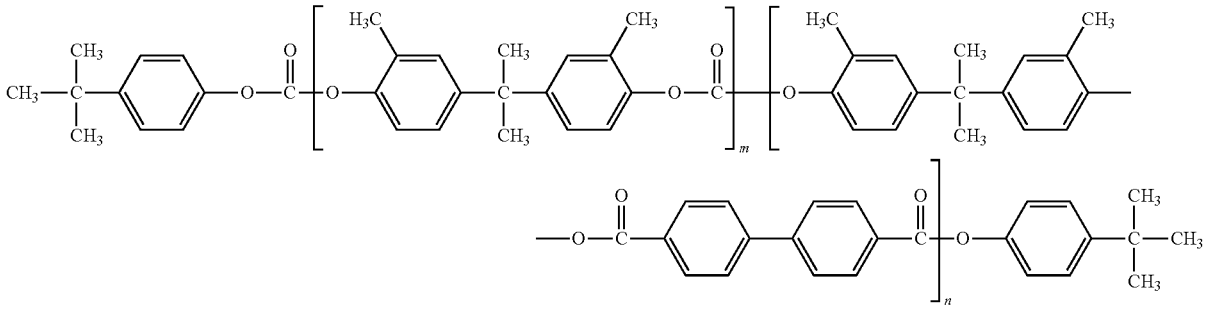

PAC-Z80BP20

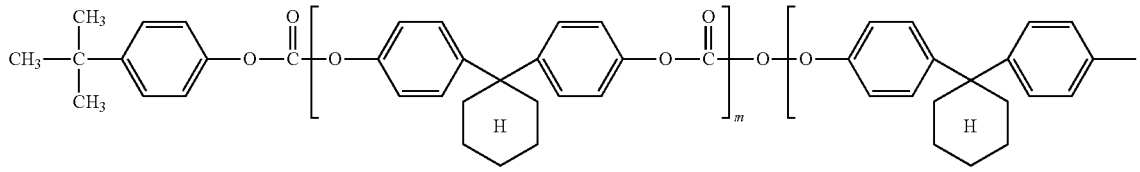

wherein m is from about 75 to about 85 mole percent, and n is from about 15 to about 25 mol percent, with the total of m and n being equal to about 100 percent; or wherein m is from about 65 to about 85 mol percent, n is from about 15 to about 35 mol percent with the total of m and n being equal to about 100 mol percent; and more specifically, where m is equal to about 80 mol percent and n is equal to about 20 mol percent, with the total of m and n being equal to about 100 mol percent; and with the viscosity average molecular weight being equal to about 62,600.

-continued

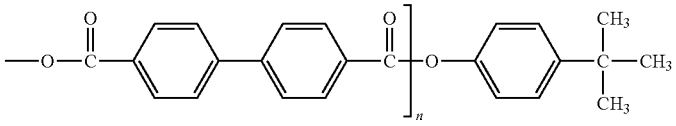

wherein m is from about 75 to about 85 mole percent and n is from about 15 to about 25 mol percent with the total of m and n being equal to about 100 mol percent and more specifically where m equals about 80 mol percent, n equals about 20 mol percent, with the total of m and n being equal to about 100 mol percent and with the viscosity average molecular weight being equal to about 46,600, and mixtures thereof.

In the charge transport layer mixture, the polyarylatecarbonates illustrated herein can be present in a number of effective amounts, such as for example, from about 40 to about 85 weight percent, from about 45 to about 80 weight percent, from about 50 to about 75 weight percent, from about 50 to about 70 weight percent, from about 55 to about 65 weight percent, or yet more specifically, about 60 weight percent based on the total solids.

The polyarylatecarbonates, such as the copolymers thereof, possess, for example, a weight average molecular weight of from about 40,000 to about 80,000, from about 45,000 to about 70,000, from about 40,000 to about 70,000, or from about 50,000 to about 60,000 as determined by GPC analysis, and a number average molecular weight of from about 30,000 to about 65,000, from about 30,000 to about 60,000, from about 35,000 to about 60,000, or from about 40,000 to about 50,000 as determined by GPC analysis.

PHOTOCONDUCTOR LAYER EXAMPLES

A number of known components can be selected for the various photoconductor layers, such as the supporting substrate layer, the photogenerating layer, the charge transport layer mixture, the ground plane layer when present, the hole blocking layer when present, the adhesive layer when present, and an optional protective top layer, such as a polymer containing top layer.

Supporting Substrates

The thickness of the photoconductor supporting substrate layer depends on many factors, including the strength desired, economical considerations, the electrical characteristics desired, adequate flexibility properties, availability, and the cost of the specific components for each layer, and the like, thus this layer may be of a substantial thickness, for example about 2,500 microns, such as from about 100 to about 2,000 microns, from about 400 to about 1,000 microns, from about 250 to about 675 microns, or from about 200 to about 600 microns ("about" throughout includes all values in between the values recited), or of a minimum thickness, such as about 50 microns. In embodiments, the thickness of the supporting substrate layer is from about 70 to about 300 microns, or from about 100 to about 175 microns. The thickness of the substrate layer depends on numerous factors, including strength desired, and economical considerations.

The photoconductor supporting substrate may be opaque or substantially transparent, and may comprise any suitable material including known or future developed materials. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, gold, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like.

In embodiments where the substrate layer is not conductive, the surface thereof may be rendered electrically conductive by an electrically conductive coating, such as a suitable metal or metal oxide. The conductive coating may vary in thickness over substantially wide ranges depending upon the optical transparency, degree of flexibility desired, and economic factors.

Illustrative examples of substrates are as illustrated herein, and more specifically, supporting substrate layers selected for the photoconductors of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Anticurl Layer

In some situations, it may be desirable to coat an anticurl layer on the back of the photoconductor substrate, particularly when the substrate is a flexible organic polymeric material. This anticurl layer, which is sometimes referred to as an anticurl backing layer, minimizes undesirable curling of the substrate. Suitable materials selected for the disclosed photoconductor anticurl layer include, for example, polycarbonates commercially available as MAKROLON®, polyesters, and the like. The anticurl layer can be of a thickness of from about 5 to about 40 microns, from about 10 to about 30 microns, or from about 15 to about 25 microns.

Ground Plane Layer

Positioned on the top side of the supporting substrate, there can be included an optional ground plane such as gold, gold containing compounds, aluminum, titanium, titanium/zirconium, and other suitable known components. The thickness of the ground plane layer can be from about 10 to about 100 nanometers, from about 20 to about 50 nanometers, from about 10 to about 30 nanometers, from about 15 to about 25 nanometers, or from about 20 to about 35 nanometers.

Hole-Blocking Layer

An optional charge blocking layer or hole blocking layer may be applied to the photoconductor supporting substrate, such as to an electrically conductive supporting substrate surface prior to the application of a photogenerating layer. An optional charge blocking layer or hole blocking layer, when present, is usually in contact with the ground plane layer, and also can be in contact with the supporting substrate. The hole blocking layer generally comprises any of a number of known components as illustrated herein, such as metal oxides, phenolic resins, aminosilanes, and the like, and mixtures thereof. The hole blocking layer can have a thickness of from about 0.01 to about 30 microns, from about 0.02 to about 5 microns, or from about 0.03 to about 2 microns.

Examples of aminosilanes included in the hole blocking layer can be represented by the following formulas/structures

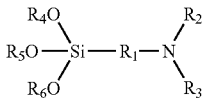

wherein $R_1$ is alkylene, straight chain, or branched containing, for example, from 1 to about 25 carbon atoms, from 1 to about 18 carbon atoms, from 1 to about 12 carbon atoms, or from 1 to about 6 carbon atoms; $R_2$ and $R_3$ are, for example, independently selected from the group consisting of at least one of a hydrogen atom, alkyl containing, for example, from 1 to about 12 carbon atoms, from 1 to about 10 carbon atoms, or from 1 to about 4 carbon atoms; aryl containing, for example, from about 6 to about 24 carbon atoms, from about 6 to about 18 carbon atoms, or from about 6 to about 12 carbon atoms, such as a phenyl group, and a poly(alkylene amino) group, such as a poly(ethylene amino) group, and where $R_4$, $R_5$ and $R_6$ are independently an alkyl group containing, for example, from 1 to about 12 carbon atoms, from 1 to about 10 carbon atoms, or from 1 to about 4 carbon atoms.

Specific examples of suitable hole blocking layer aminosilanes include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy) silane, p-aminophenyl trimethoxysilane, N,N'-dimethyl-3-aminopropyl triethoxysilane, 3-aminopropyl methyl diethoxysilane, 3-aminopropyl trimethoxysilane, N-methylaminopropyl triethoxysilane, methyl[2-(3-trimethoxysilylpropylamino) ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Specific aminosilanes incorporated into the hole blocking layer are 3-aminopropyl triethoxysilane (γ-APS), N-aminoethyl-3-aminopropyl trimethoxysilane, (N,N'-dimethyl-3-amino)propyl triethoxysilane, or mixtures thereof.

The hole blocking layer aminosilane may be treated to form a hydrolyzed silane solution before being added into the final hole blocking layer coating solution or dispersion. During hydrolysis of the aminosilanes, the hydrolyzable groups, such as the alkoxy groups, are replaced with hydroxyl groups. The pH of the hydrolyzed silane solution can be controlled to from about 4 to about 10, or from about 7 to about 8 to thereby result in photoconductor electrical stability. Control of the pH of the hydrolyzed silane solution may be affected with any suitable material, such as generally organic acids or inorganic acids. Examples of organic and inorganic acids selected for pH control include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or a dispersion onto the photoconductor supporting substrate, or on to the ground plane layer by the use of a spray coater, a dip coater, an extrusion coater, a roller coater, a wire-bar coater, a slot coater, a doctor blade coater, a gravure coater, and the like, and dried at, for example, from about 40° C. to about 200° C. or from 75° C. to 150° C. for a suitable period of time, such as for example, from about 1 to about 4 hours, from about 1 to about 10 hours, or from about 40 to about 100 minutes in the presence of an air flow. The hole blocking layer coating can be accomplished in a manner to provide a final hole blocking layer thickness after drying of, for example, from about 0.01 to about 30 microns, from about 0.02 to about 5 microns, or from about 0.03 to about 2 microns.

Adhesive Layer

An optional adhesive layer may be included between the photoconductor hole blocking layer and the photogenerating layer. Typical adhesive layer materials selected for the photoconductors illustrated herein, include polyesters, polyurethanes, copolyesters, polyamides, poly(vinyl butyrals), poly (vinyl alcohols), polyacrylonitriles, and the like, and mixtures thereof. The adhesive layer thickness can be, for example, from about 0.001 to about 1 micron, from about 0.05 to about 0.5 micron, or from about 0.1 to about 0.3 micron. Optionally, the adhesive layer may contain effective suitable amounts of from about 1 to about 10 weight percent or from about 1 to about 5 weight percent of conductive particles, such as zinc oxide, titanium dioxide, silicon nitride, and carbon black, nonconductive particles, such as polyester polymers, and mixtures thereof.

Photogenerating Layer

Usually, the disclosed photoconductor photogenerating layer is applied by vacuum deposition or by spray drying onto the supporting substrate, and at least one charge transport layer is formed on the photogenerating layer. The charge transport layer may be situated on the photogenerating layer, the photogenerating layer may be situated on the charge transport layer, or when more than one charge transport layer is present, they can be contained on the photogenerating layer. Also, the photogenerating layer may be applied to any of the layers that are situated between the supporting substrate and the charge transport layer.

Generally, the photogenerating layer can contain known photogenerating pigments, such as metal phthalocyanines, metal free phthalocyanines, alkylhydroxyl gallium phthalocyanines, hydroxygallium phthalocyanines, halogallium phthalocyanines, such as chlorogallium phthalocyanines, perylenes, such as bis(benzimidazo)perylene, titanyl phthalocyanines, especially Type V titanyl phthalocyanine, and the like, and mixtures thereof.

Examples of photogenerating pigments included in the photogenerating layer are vanadyl phthalocyanines, hydroxygallium phthalocyanines, such as Type V and Type C hydroxygallium phthalocyanines, high sensitivity titanyl phthalocyanines, Type IV and V titanyl phthalocyanines, quinacridones, polycyclic pigments, such as dibromo anthanthrone pigments, perinone diamines, polynuclear aromatic quinones, azo pigments including bis-, tris- and tetrakis-azos, and the like, and other known photogenerating pigments; inorganic components, such as selenium, selenium alloys, and trigonal selenium; and pigments of crystalline selenium and its alloys.

The photogenerating pigment can be dispersed in a resin binder, or alternatively, no resin binder need be present. For example, the photogenerating pigments can be present in an optional resinous binder composition in various amounts inclusive of up to from about 99.5 to about 100 weight percent by weight based on the total solids of the photogenerating layer. Generally, from about 5 to about 95 percent by volume of the photogenerating pigment is dispersed in about 95 to about 5 percent by volume of a resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition.

Examples of polymeric binder materials that can be selected as the matrix or binder for the disclosed photogenerating layer pigments include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, amino resins, phenylene oxide resins, terephthalic acid resins, phenoxy resins, epoxy resins, phenolic resins, acrylonitrile copolymers, poly(vinyl chloride), vinyl chloride and vinyl acetate copolymers, acrylate copolymers, alkyd resins, cellulosic film formers, poly (amideimide), styrene butadiene copolymers, vinylidene chloride-vinyl chloride copolymers, vinyl acetate-vinylidene chloride copolymers, styrene-alkyd resins, poly(vinyl carbazole), and the like, inclusive of block, random, or alternating copolymers thereof.

It is often desirable to select a coating solvent for the disclosed photogenerating layer mixture, and which solvent does not substantially disturb or adversely affect the previously coated layers of the photoconductor. Examples of coating solvents used for the photogenerating layer coating mixture include ketones, alcohols, aromatic hydrocarbons, halogenated aliphatic hydrocarbons, ethers, amines, amides, esters, and the like, and mixtures thereof. Specific solvent examples selected for the photogenerating mixture are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer can be of a thickness of from about 0.01 to about 10 microns, from about 0.05 to about 10 microns, from about 0.2 to about 2 microns, or from about 0.25 to about 1 micron.

Charge Transport Layer

The disclosed charge transport layer or at least one charge transport layer, and more specifically, in embodiments, a first or bottom charge transport layer in contact with the photogenerating layer, and included over the first or bottom charge transport layer a top or second charge transport overcoating layer, comprising charge transporting compounds or molecules dissolved, or molecularly dispersed in a film forming electrically inert polymer such as a polycarbonate and the polyarylatecarbonates disclosed herein. In embodiments, "dissolved" refers, for example, to forming a solution in which the charge transport molecules are dissolved in a polymer to form a homogeneous phase; and molecularly dispersed refers, for example, to charge transporting molecules or compounds dispersed on a molecular scale in a polymer.

In embodiments, charge transport refers, for example, to charge transporting molecules that allow the free charges generated in the photogenerating layer to be transported across the charge transport layer. The charge transport layer is usually substantially nonabsorbing to visible light or radiation in the region of intended use, but is electrically active in that it allows the injection of photogenerated holes from the photoconductive layer, or photogenerating layer, and permits these holes to be transported to selectively discharge surface charges present on the surface of the photoconductor.

A number of charge transport compounds can be included in the polyarylatecarbonate charge transport layer mixture or in at least one charge transport layer where at least one charge transport layer is, for example, from 1 to about 5 layers, from 1 to about 3 layers, 2 layers, or 1 layer. Examples of charge transport components or compounds present in an amount of, for example, from about 15 to about 50 weight percent, from about 35 to about 45 weight percent, or from about 40 to about 45 weight percent based on the total solids of the at least one charge transport layer are the compounds as illustrated in Xerox Corporation U.S. Pat. No. 7,166,397, the disclosure of which is totally incorporated herein by reference, and more specifically, aryl amine compounds or molecules selected from the group consisting of those represented by the following formulas/structures

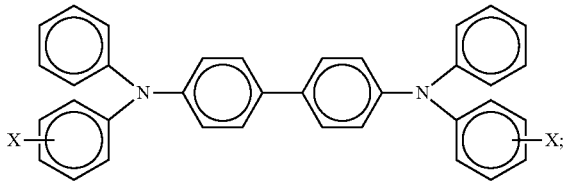

and

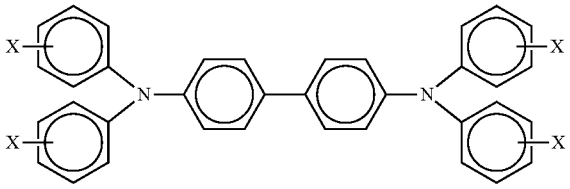

wherein X is a suitable hydrocarbon like alkyl, alkoxy, aryl, isomers thereof, and derivatives thereof like alkylaryl, alkoxyaryl, arylalkyl; a halogen, or mixtures of a suitable hydrocarbon and a halogen; and charge transport layer compounds as represented by the following formula/structure

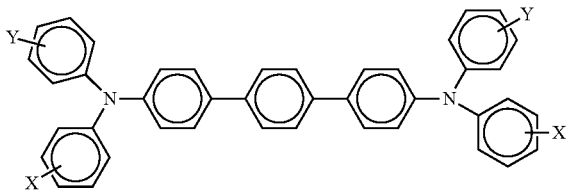

wherein X and Y are independently alkyl, alkoxy, aryl, a halogen, or mixtures thereof.

Alkyl and alkoxy for the photoconductor charge transport layer compounds illustrated herein contain, for example, from about 1 to about 25 carbon atoms, from about 1 to about 12 carbon atoms, or from about 1 to about 6 carbon atoms, such as methyl, ethyl, propyl, butyl, pentyl, hexyl, heptyl, octyl, nonyl, decyl, undecyl, dodecyl, pentadecyl, and the like, and the corresponding alkoxides. Aryl substituents for the charge transport layer compounds can contain from 6 to about 36, from 6 to about 24, from 6 to about 18, or from 6 to about 12 carbon atoms, such as phenyl, naphthyl, anthryl, and the like. Halogen substituents for the charge transport layer compounds include chloride, bromide, iodide, and fluoride. Substituted alkyls, substituted alkoxys, and substituted aryls can also be selected for the disclosed charge transport layer compounds.

Examples of specific aryl amines present in at least one photoconductor charge transport layer include N,N,N',N'-tetra-p-tolyl-1,1'-biphenyl-4,4'-diamine, N,N'-diphenyl-N,N'-bis(alkylphenyl)-1,1'-biphenyl-4,4'-diamine, wherein alkyl is selected from the group consisting of methyl, ethyl, propyl, butyl, hexyl, heptyl, octyl, nonyl, decyl, undecyl, dodecyl, pentadecyl, and the like, N,N'-diphenyl-N,N'-bis(halophenyl)-1,1'-biphenyl-4,4'-diamine wherein the halo substituent is chloro, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like, hydrazones such as N-phenyl-N-methyl-3-(9-ethyl)carbazyl hydrazone and 4-diethyl amino benzaldehyde-1,2-diphenyl hydrazine, or oxadiazoles, such as 2,5-bis(4-N,N'-diethylaminophenyl)-1,2,4-oxadiazole, stilbenes, and the like.

Various processes may be used to mix, and thereafter apply the charge transport layer or layers coating mixture to the photogenerating layer. Typical charge transport layer application techniques include spraying, dip coating, roll coating, wire wound rod coating, and the like. Drying of the deposited charge transport layer coating or plurality of coatings may be affected by any suitable conventional technique such as oven drying, infrared radiation drying, air drying, and the like.

The thickness of the at least one charge transport layer is, for example, from about 5 to about 80 microns, from about 20 to about 65 microns, from about 15 to about 50 microns, or from about 10 to about 40 microns, but thicknesses outside these ranges may, in embodiments, also be selected. The charge transport layer should be an insulator to the extent that an electrostatic charge placed on the charge transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances about 400:1.

Examples of optional binders that, for example, permit enhanced miscibility of the charge transport component and selected for the disclosed photoconductor charge transport layers, include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof, and more specifically, polycarbonates such as poly(4,4'-isopropylidene-diphenylene) carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive optional resin binders are comprised of polycarbonate resins with a weight average molecular weight of from about 20,000 to about 100,000, or with a weight average molecular weight $M_w$ of from about 50,000 to about 100,000. Generally, the transport layer contains from about 10 to about 75 percent by weight of the charge transport material, and more specifically, from about 35 to about 50 percent of this material.

In embodiments, a charge transport compound can be represented by the following formulas/structures

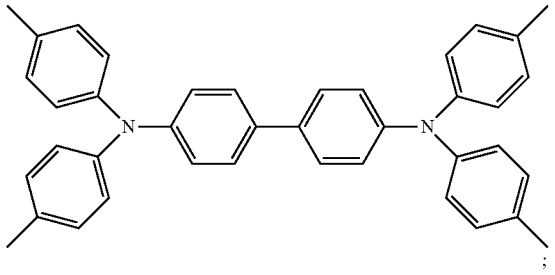

;

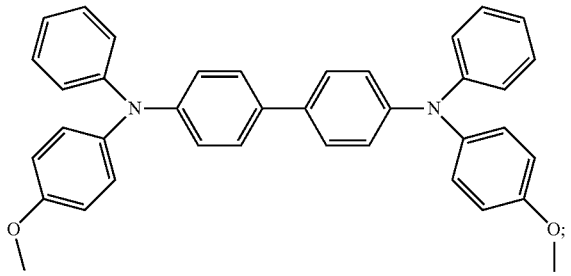

-continued

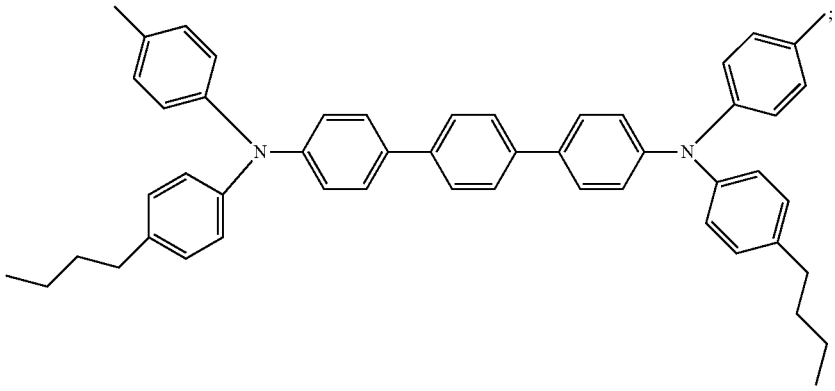

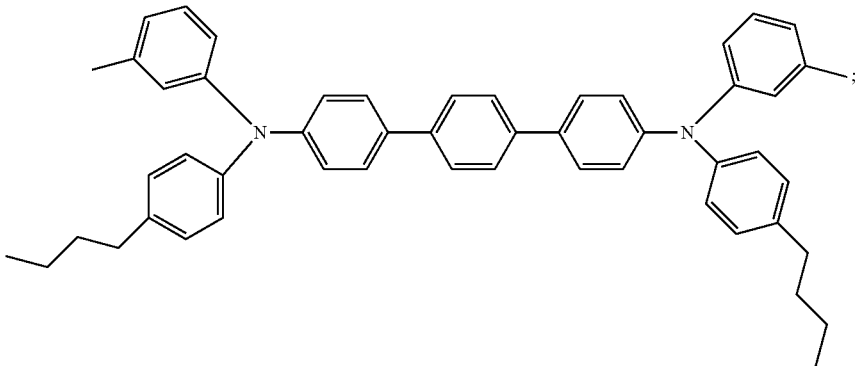

and

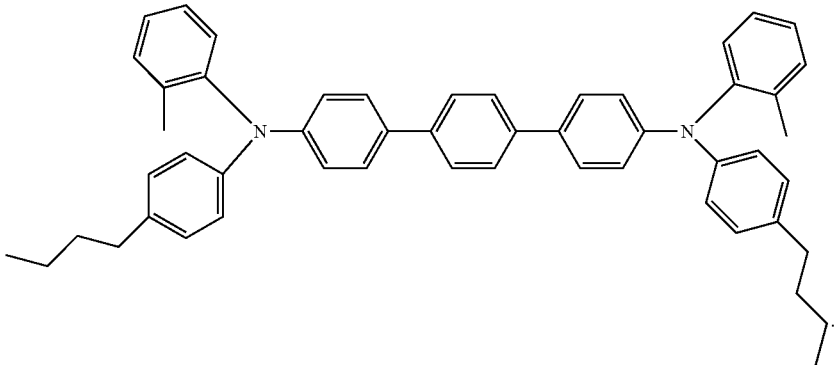

Examples of components or materials optionally incorporated into at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

The photoconductor wear rates, when selecting for the charge transport layer a mixture of a charge transport compound and the polyarylatecarbonates illustrated herein, are, for example, reduced by from about 30 to about 70 percent, and more specifically, from about 40 to about 60 weight percent as compared to a similar known photoconductor that is free of the charge transport layer polyarylatecarbonate. Thus, the polyarylatecarbonate containing photoconductor wear rate, measured using an in house known wear fixture (BCR system, peak-to-peak voltage=1.8 kV) as illustrated herein is from about 30 to about 55 nanometers/kilocycle, from about 40 to about 55 nanometers/kilocycle, or from about 35 to about 50 nanometers/kilocycle.

In addition to excellent wear characteristics, the disclosed photoconductors have color print stability and excellent cyclic stability of almost no or a minimal change in a generated known photoinduced discharge curve (PIDC), especially no or minimal residual potential cycle up after a number of charge/discharge cycles of the photoconductor, for example about 100 kilocycles, or xerographic prints of, for example, from about 80 to about 100 kiloprints. Color print stability refers, for example, to substantially no or minimal change in solid area density, especially in 60 percent halftone prints, and no or minimal random color variability from print to print after a number of xerographic prints, for example 50 kiloprints.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of a thermoplastic resin, a colorant, such as a pigment, dye, or mixtures thereof, a charge additive, internal additives like waxes, and surface additives, such as for example silica, coated silicas, aminosilanes, and the like, reference U.S. Pat. Nos. 4,560,635 and 4,338,390, the disclosures of each of these patents being totally incorporated herein by reference, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 110 copies per minute. Processes of imaging, especially xerographic imaging and printing, including digital and/or color printing, are thus encompassed by the present disclosure.

The imaging members or photoconductors illustrated herein are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed, for example at least 100 copies per minute, color copying and printing processes.

The following Examples are being submitted to illustrate embodiments of the present disclosure. Molecular weights were determined by Gel Permeation analysis. The ratios recited were determined primarily by the amount of components selected for the preparations indicated.

Comparative Example 1

An undercoat layer was prepared, and then deposited on a 30 millimeter thick aluminum drum substrate as follows.

Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting solution was then coated by a dip coater on the above 30 millimeter thick aluminum drum substrate, and where the coating solution layer was pre-heated at 59° C. for 13 minutes, humidified at 58° C. (dew point=54° C.) for 17 minutes, and dried at 135° C. for 8 minutes. The thickness of the resulting undercoat layer was approximately 1.3 microns.

A photogenerating layer, 0.2 micron in thickness, comprising chlorogallium phthalocyanine (Type C) was deposited on the above undercoat layer. The photogenerating layer coating dispersion was prepared as follows. 2.7 Grams of chlorogallium phthalocyanine (ClGaPc) Type C pigment were mixed with 2.3 grams of the polymeric binder (carboxyl-modified vinyl copolymer, VMCH, available from Dow Chemical Company), 15 grams of n-butyl acetate, and 30 grams of xylene. The resulting mixture was mixed in an Attritor mill with about 200 grams of 1 millimeter Hi-Bea borosilicate glass beads for about 3 hours. The dispersion mixture obtained was then filtered through a 20 micron Nylon cloth filter, and the solids content of the dispersion was diluted to about 6 weight percent.

Subsequently, a 32 micron charge transport layer was coated on top of the above photogenerating layer from a solution prepared by dissolving N,N'-diphenyl-N,N-bis(3-methylphenyl)-1,1'-biphenyl-4,4'-diamine (mTBD, 4 grams), and a film forming polymer binder PCZ-400 [poly(4,4'-dihydroxy-diphenyl-1-1-cyclohexane carbonate), $M_w$=40,000] available from Mitsubishi Gas Chemical Company, Ltd. (6 grams), and 0.1 gram of a butylated hydroxytoluene (BHT) in a 70/30 solvent mixture of tetrahydrofuran (THF)/toluene, followed by drying in an oven at about 120° C. for about 40 minutes. The resulting charge transport layer PCZ-400/mTBD/BHT ratio was 59.4/39.6/1.

Example I

A photoconductor was prepared by repeating the process of Comparative Example 1 except that the 32 micron thick charge transport layer was coated on top of the photogenerating layer from a solution prepared from a mixture of N,N'-diphenyl-N,N-bis(3-methylphenyl)-1,1'-biphenyl-4,4'-diamine (mTBD), 39 weight percent, 60 weight percent of the polyarylatecarbonate copolymer obtained from Mitsubishi Gas Chemical Company, Inc. (MGC) and identified herein as PAC-C80BP20 of the following formula/structure

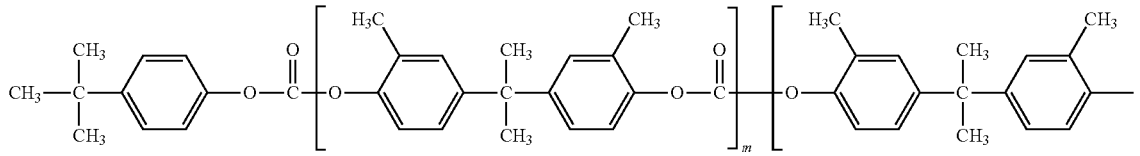

-continued

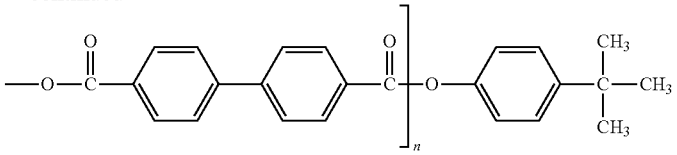

where m is 80 mol percent, n is 20 mol percent, and the total thereof is 100 mol percent, and the viscosity average molecular weight was 62,600 as provided by MGC, and which viscosity average molecular may be determined by known viscosity measurement processes, and 1 weight percent of butylated hydroxytoluene (BHT) dissolved in a solvent mixture of tetrahydrofuran/toluene 70/30. The 32 micron thick charge transport layer resulting was comprised of PAC-C80BP20/mTBD/BHT in a 59.4/39.6/1 weight percent ratio.

Example II

A photoconductor was prepared by repeating the process of Example I except that the polyarylatecarbonate copolymer PAC-C80BP20 was replaced with PAC-Z80BP20, obtained from Mitsubishi Gas Chemical Company, Inc., and of the following formula/structure

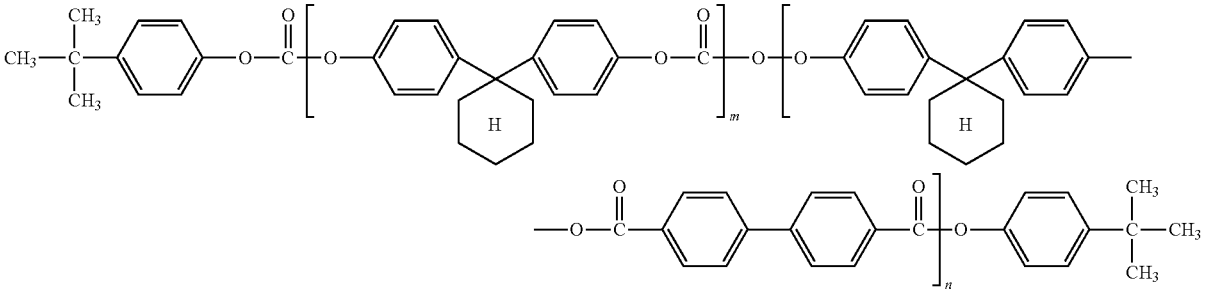

where m is 80 mol percent; n is 20 mol percent, and the total thereof is 100 mol percent, and the viscosity average molecular weight was 46,600 as provided by MGC, and which may be determined by known viscosity measurement processes. The 32 micron thick charge transport layer resulting was comprised of PAC-Z80BP20/mTBD/BHT in a 59.4/39.6/1 weight percent ratio.

Example III

A photoconductor is prepared by repeating the process of Example I except that the polyarylatecarbonate copolymer PAC-C80BP20 is replaced with PAC-A80BP20, obtained from Mitsubishi Gas Chemical Company, Inc., of the following formula/structure

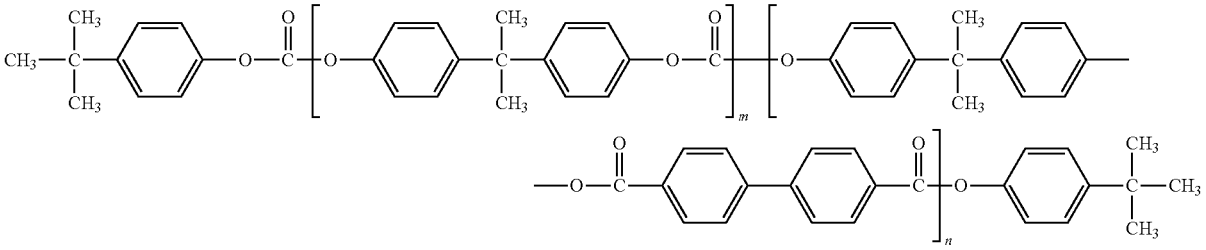

where m is 80 mol percent; n is 20 mol percent, and the total thereof is 100 mol percent, and the viscosity average molecular weight is 57,200 as provided by MGC, and which may be determined by known viscosity measurement processes. The 32 micron thick charge transport layer resulting is comprised of PAC-A80BP20/mTBD/BHT in a 59.4/39.6/1 weight percent ratio.

ELECTRICAL PROPERTY TESTING

The above prepared photoconductors of Comparative Example 1 and Examples I and II were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The above photoconductors were tested at surface potentials of 700 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

Substantially similar PIDCs were obtained for the above photoconductors. Therefore, the incorporation of the above polyarylatecarbonates of Examples I and II into charge transport layers did not adversely affect the electrical properties of this photoconductors.

WEAR TESTING

Wear tests of the photoconductors of Comparative Example 1 and Examples I and II were performed using an in house wear test fixture (biased charging roll charging with peak to peak voltage of 1.8 kilovolts). The total thickness of each photoconductor was measured via Permascope before each wear test was initiated. Then the photoconductors were separately placed into the wear fixture for 100 kilocycles. The total photoconductor thickness was measured again with the Permascope, and the difference in thickness was used to calculate wear rate (nanometers/kilocycle) of the photoconductors. The smaller the wear rate, the more wear resistant was the photoconductor.

There resulted an improved wear rate of 56.3 nm/kcycle for the Example I photoconductor versus a wear rate of 90 nm/kcycle for the Comparative Example 1 photoconductor, which represents an about 60 percent wear rate improvement for the Example I photoconductor.

Additionally, there resulted an improved wear rate of 56.6 nm/kcycle for the Example II photoconductor versus a wear rate of 90 nm/kcycle for the Comparative Example 1 photoconductor, which represents an about 60 percent wear rate improvement for the Example II photoconductor.

Thus, it is expected, in accordance with the principles of the teachings of the present disclosure, that photoconductors possessing wear rates of from about 35 to about 65 nm/kcycle, from about 40 to about 60 nm/kcycle, from about 30 to about 57 nanometers/kilocycle, from about 40 to about 55 nanometers/kilocycle, or from about 35 to about 50 nanometers/kilocycle are achievable.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a a supporting substrate, a photogenerating layer and a charge transport layer that includes a charge transport compound, and a polyarylatecarbonate copolymer selected from the group consisting of those represented by the following formulas/structures

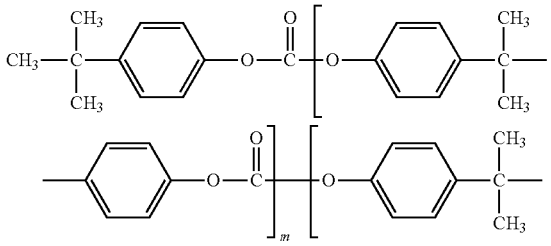

-continued

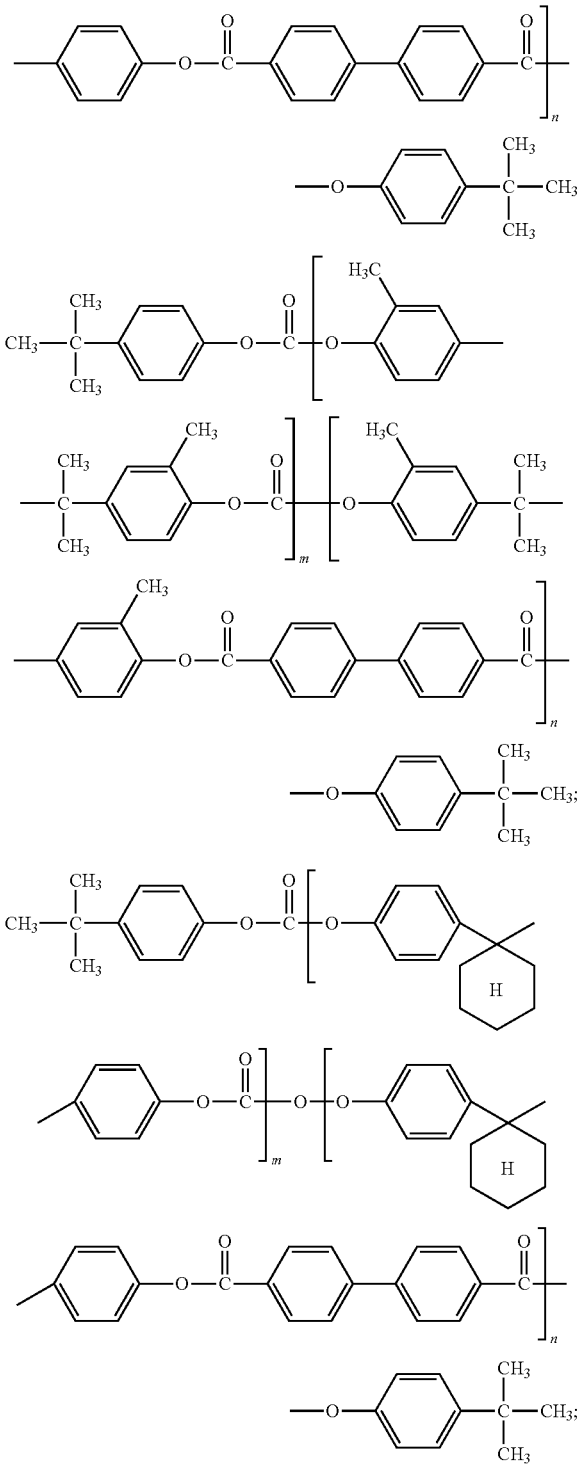

and mixtures thereof, wherein m and n represent the mol percents of each segment with m being from about 60 to about 95 mol percent and n being from about 5 to about 40 mol percent and wherein the total thereof is about mol 100 percent.

2. A photoconductor in accordance with claim 1 wherein said polyarylatecarbonate copolymer is represented by the following formulas/structures

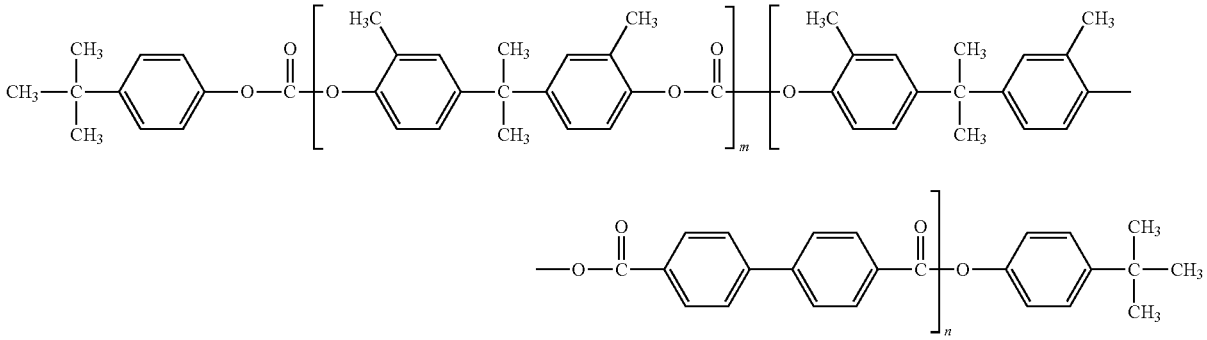

wherein m is from about 75 to about 85 mol percent, n is from about 15 to about 25 mol percent with the total of m and n being equal to about 100 mol percent.

3. A photoconductor in accordance with claim 1 wherein m is from about 60 to about 90 mol percent, and n is from about 10 to about 40 mol percent.

4. A photoconductor in accordance with claim 1 wherein m is from about 65 to about 85 mol percent, and n is from about 15 to about 35 mol percent.

5. A photoconductor in accordance with claim 1 wherein said copolymer is represented by the following formulas/structures

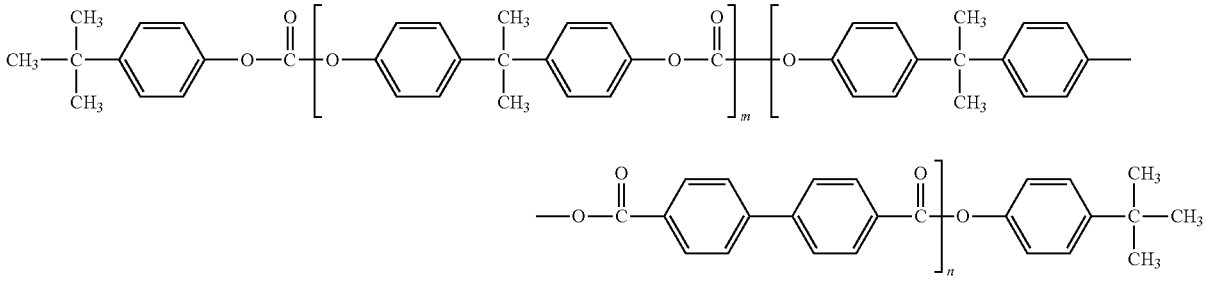

wherein m is from about 75 to about 85 mole percent, and n is from about 15 to about 25 mol percent.

6. A photoconductor in accordance with claim 1 wherein said copolymer is represented by the following formulas/structures

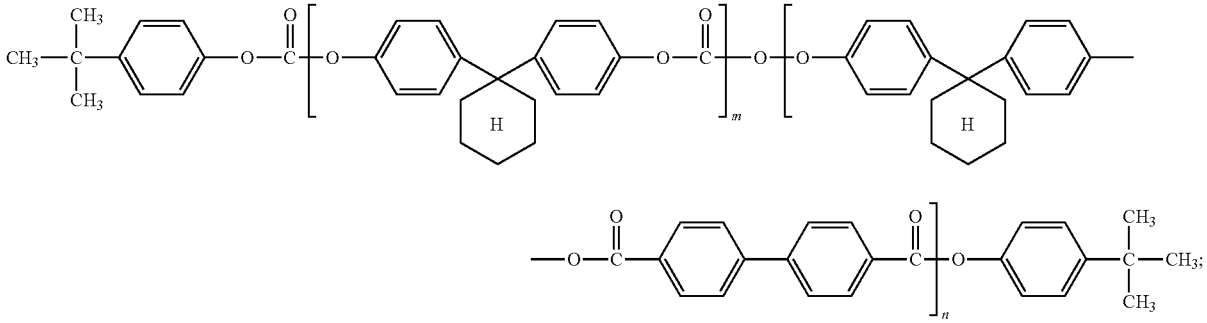

wherein m is from about 75 to about 85 mole percent, and n is from about 15 to about 25 mol percent.

7. A photoconductor in accordance with claim 1 wherein said copolymer possesses a weight average molecular weight of from about 40,000 to about 70,000, and a number average molecular weight of from about 30,000 to about 60,000 as determined by GPC analysis.

8. A photoconductor in accordance with claim 1 wherein said copolymer is present in an amount of from about 45 to about 80 weight percent based on the solids.

9. A photoconductor in accordance with claim 1 wherein said copolymer is present in an amount of from about 50 to about 70 weight percent based on the solids.

10. A photoconductor in accordance with claim 1 wherein said charge transport layer is comprised of a first charge transport layer in contact with said photogenerating layer, and a second charge transport layer in contact with said first charge transport layer, and wherein said copolymer is present in said second charge transport layer.

11. A photoconductor in accordance with claim 1 wherein said charge transport compound is represented by at least one of

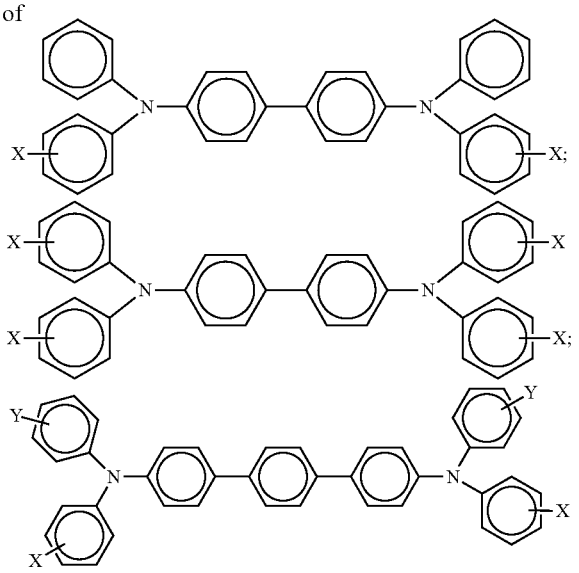

-continued and

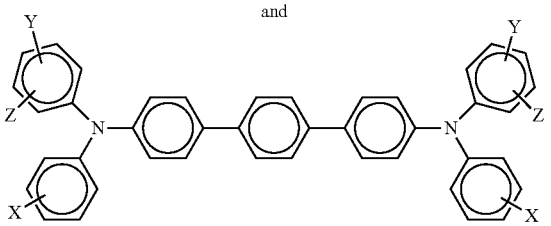

wherein X, Y, and Z are independently selected from the group consisting of alkyl, alkoxy, aryl, halogen, and mixtures thereof.

12. A photoconductor in accordance with claim 1 wherein said charge transport compound is selected from the group consisting of N,N'-bis(methylphenyl)-1,1-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

13. A photoconductor in accordance with claim 1 wherein said photogenerating layer is comprised of at least one photogenerating pigment.

14. A photoconductor in accordance with claim 1 wherein said photogenerating layer is comprised of at least one of a titanyl phthalocyanine, a hydroxygallium phthalocyanine, a halogallium phthalocyanine, a bisperylene, and mixtures thereof.

15. A photoconductor comprised in sequence of a supporting substrate, a hole blocking layer thereover, a photogenerating layer, and a charge transport layer comprised of a mixture of an aryl amine hole transport compound and a polyarylatecarbonate as represented by the following formulas/structures

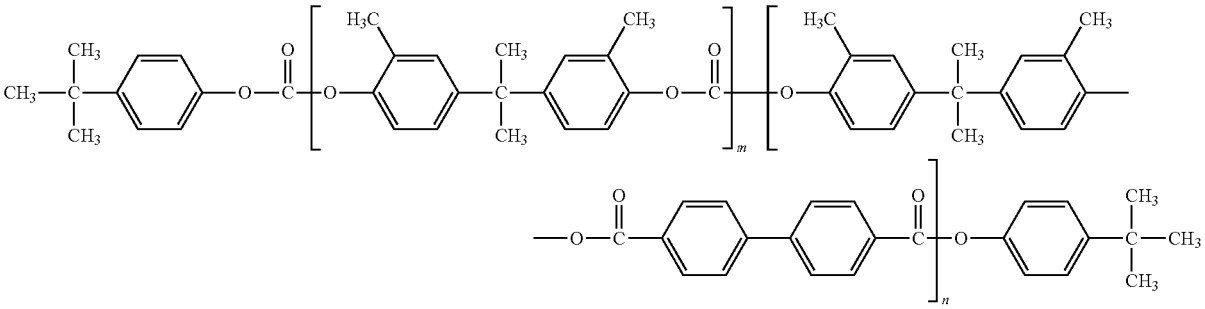

wherein m is from about 65 to about 85 mol percent, and n is from about 15 to about 35 mol percent, and the total thereof is 100 mol percent.

16. A photoconductor in accordance with claim 15 wherein said aryl amine is N,N'-diphenyl-N,N-bis(3-methylphenyl)-1,1'-biphenyl-4,4'-diamine; said m is from about 75 to about 85 mol percent, and said n is from about 15 to about 25 mol percent.

17. A photoconductor in accordance with claim 15 wherein said hole blocking layer is comprised of an aminosilane of at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and mixtures thereof.

18. A photoconductor comprising a supporting substrate, a hole blocking layer thereover, a photogenerating layer, and a hole transport layer comprised of a mixture of a hole transport compound and a polyarylatecarbonate copolymer selected from the group consisting of those represented by the following formulas/structures

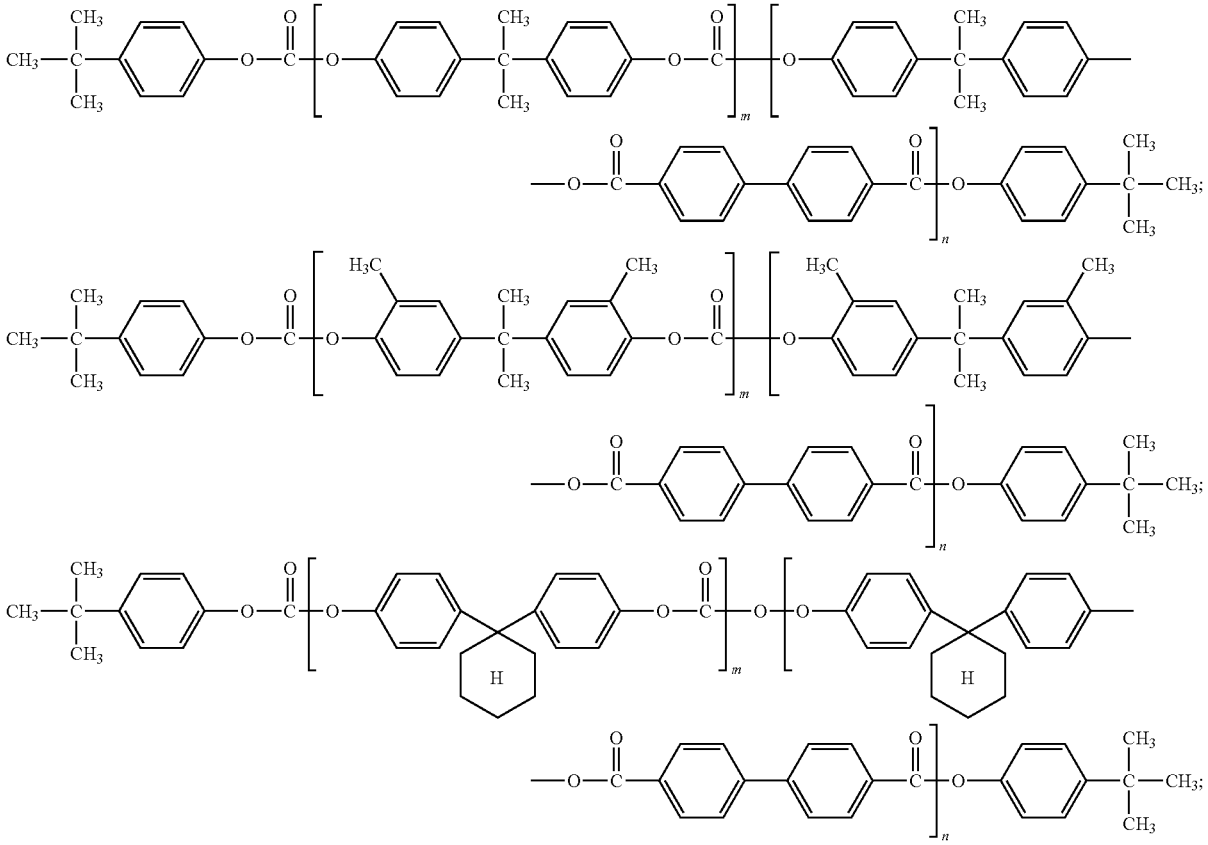
35
and mixtures thereof, wherein m and n represent the mol percents of each segment with m being from about 60 to about 95 mol percent and n being from about 5 to about 40 mol percent and wherein the total thereof is about mol 100 percent.
* * * * *